United States Patent [19]

Hoering

[11] Patent Number: 4,916,675

[45] Date of Patent: Apr. 10, 1990

[54] BROADBAND OMNIDIRECTIONAL ELECTROACOUSTIC TRANSDUCER

[75] Inventor: Friedrich Hoering, Kiel, Fed. Rep. of Germany

[73] Assignee: Honeywell Elac Nautik GmbH, Fed. Rep. of Germany

[21] Appl. No.: 345,878

[22] Filed: May 1, 1989

[30] Foreign Application Priority Data

Apr. 13, 1988 [DE] Fed. Rep. of Germany ..... 3812244

[51] Int. Cl.[4] ..... H04R 17/00

[52] U.S. Cl. ..... 367/153; 367/155; 367/158; 310/337

[58] Field of Search ..... 367/153, 159, 155, 158; 310/337, 334

[56] References Cited

U.S. PATENT DOCUMENTS

| | | | |
|---|---|---|---|
| 2,484,626 | 10/1949 | Keller | 367/155 |
| 3,457,543 | 7/1969 | Akervold et al. | 367/155 |
| 3,952,216 | 4/1976 | Madison et al. | 367/155 |
| 4,100,527 | 7/1978 | Tocquet | 310/337 |
| 4,151,437 | 4/1979 | Tocquet | 310/337 |
| 4,380,808 | 4/1983 | Hill et al. | 367/153 |
| 4,439,847 | 3/1984 | Massa | 310/337 |

*Primary Examiner*—Charles T. Jordan
*Assistant Examiner*—J. Woodrow Eldred
*Attorney, Agent, or Firm*—Charles L. Rubow

[57] ABSTRACT

An omnidirectional acoustic transducer achieves a broadband radiation or reception pattern with high efficiency by using several transducer rings located side-by-side with each ring comprising a plurality of radially directed individual transducer elements. The transducer elements in each of the rings are tuned to a particular natural frequency and are designed accordingly. Within each ring the transducer elements are energized in phase with one another. The natural frequency of the individual transducer elements differs from one ring to the other.

5 Claims, 1 Drawing Sheet

BROADBAND OMNIDIRECTIONAL ELECTROACOUSTIC TRANSDUCER

The invention relates to a broadband omnidirectional electroacoustic transducer for underwater sound transmission and reception.

BACKGROUND OF THE INVENTION

U.S. Pat. No. 4,604,542 describes a broadband radial vibrator transducer having at least two laminar resonant sections coupled to a radial electromechanical transducer element where each laminar section includes at least two layers. Each resonant section has a mass layer and a compliant member layer where the compliant member layer is fixed between the transducer element and the mass layer. The compliant member allows the resonant section to mechanically resonate along with the transducer element providing at least two resonant frequencies, thereby expanding the bandwidth of the transducer.

SUMMARY OF THE INVENTION

It is the main object of the present invention to describe a broadband omnidirectional electroacoustic transducer having an almost ball-shaped or spheric transmission or reception diagram such that it works like an omnidirectional point source. To achieve this objective the transducer according to the invention comprises a plurality of transducer rings positioned side-by-side along a common axis, with each ring consisting of a plurality of radially directed transducer elements, which may be of the Tonpilz type located side-by-side around the circumference of said ring and adapted for radial transmission of sound waves. According to the invention, the natural frequency of the transducer elements of each transducer ring differs from the natural frequency of the transducer elements of the adjacent transducer rings. Instead of having the individual transducer elements oscillating on two different resonant frequencies as shown in U.S. Pat. No. 4,604,542, the invention provides ring-shaped groups of transducer elements with each group oscillating on a different resonant frequency. Depending on the desired width of the frequency band, there might be provided two, three or more rings of transducer elements. Preferably the height of the individual transducer element of a particular transducer ring seen along the common axis of said ring is chosen equal or smaller than half of the wavelength corresponding to the natural frequency of the transducers in said ring. Further preferred details and modifications of the invention are described in the dependent claims. The invention will now be described with reference to embodiments shown in the drawings.

BRIEF DESCRIPTION OF THE DRAWINGS

In FIG. 1 a common support tube 1 carries several, in the present case three, transducer rings R1, R2 and R3 of which each one comprises a plurality of tonpilz-type transducer elements. All transducer elements within a particular ring have the same natural frequency and are actuated with this natural frequency without phase shift. The dimensions of the transducer elements in each ring are chosen such that their height H1, H2 and H3, respectively, seen in the direction of the common axis 2 is either equal or smaller than the half wavelength of the sound waves which are to be emitted or received, which means $H \leqq \lambda/2$. In this equation $\lambda$ is the wavelength at the associated band central frequency of the particular frequency band associated to the respective transducer ring. In FIG. 1 three of such transducer rings R1 to R3 are stacked one above the other, but if required a different number of rings can be provided. In FIG. 1 the height H of the transducer elements in each ring decreases from the top to the bottom. The arrangement can also be made inversly, i.e. with the height decreasing from the bottom to the top or it could be made symmetrical such that starting from a central ring the height decreases to the bottom as well as to the top of the tube-like transducer.

In the portions 3 and 4 above and below the transducer stack other parts of the transducer apparatus such as filters and drivers might be provided within the common cylindrical housing 5. The omnidirectional radiation pattern of the transducer is not impaired by such portions 3 and 4. This pattern has almost the shape of a ball or sphere so that the transducer has a radiation pattern like a ball but is much more effective than an expanding and contracting ball transducer.

The individual transducer rings R1 to R3 contain a plurality of individual transducer elements, whereat the number of transducer elements mainly depends on the central frequency of the partial frequency band which has to be transmitted or received by said transducer ring. This central frequency as mentioned above is determinative of the dimensions, in particular the height H of the individual transducer element. The various transducer rings either individually or commonly by means of coating with plastic material or vulcanizing of a rubber layer or by other means can be protected against humidity entering the inside portion of the transducer. Also, a common oil fill or a common housing of plastic or rubber might be provided.

Figure 1:
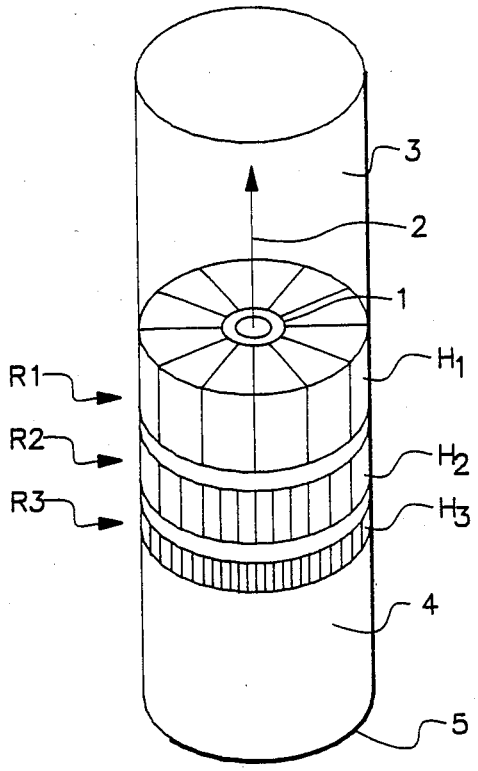
FIG. 1 shows an example of an electroacoustic transducer according to the invention in a perspective view including three rings R1 to R3 of transducers.
Figure 2:
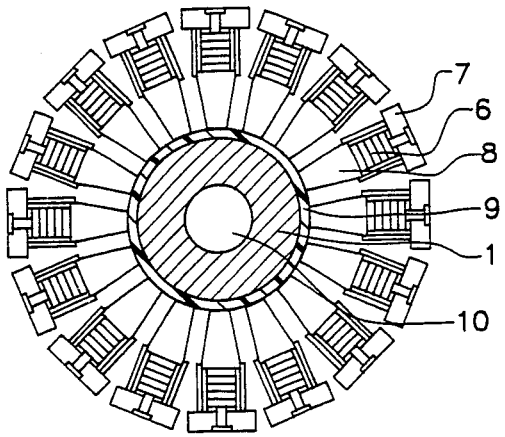
FIG. 2 shows a cross-section through such kind of transducer, cut in parallel to the plane of a transducer ring where several Tonpilz-type transducer elements are supported by a common support tube.

FIG. 2 shows a first embodiment of one of the transducer rings R shown as a section orthogonal to common axis 2. The individual transducer elements have the shape of a so-called Tonpilz (see U.S. Pat. No. 4,072,871, column 1, lines 53 to 56), where a stack 6 of piezoelectric oscillating members is provided between a resonant mass 7 and a counter mass 8. Each of these transducer elements is fixed to a common support tube 1, whereat a damping or compliance layer 9, e.g. made of plastic material, is provided between the Tonpilz and the support tube. The internal space 10 of the support tube 1 may be used for making the electrical connections to the transducer elements and for feeding the electrical cables therethrough. A plurality of transducer elements, each one consisting of a stack of piezoceramic generator elements, a resonant mass 7 and a counter mass 8 is equally spaced around the circumference of the ring and covers almost the entire outer surface of the ring.

Figure 3:
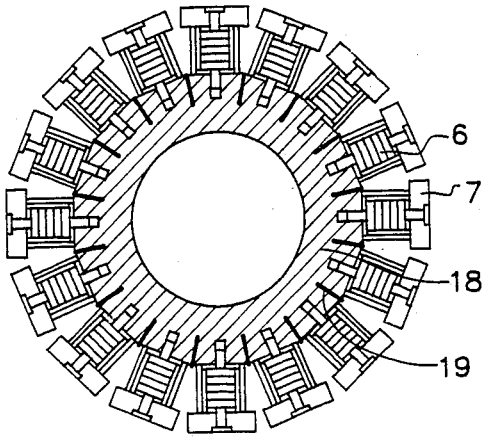
FIG. 3 shows a corresponding sectional view, cut through another embodiment where all transducer elements are supported by a common hollow-cylindrical counter mass.

In the embodiment of FIG. 3 each Tonpilz or transducer element consists of a stack 6 of piezoceramic generator elements and a resonant mass 7. These transducer elements are fixed to a common counter mass 8 which in turn is held by a support tube or forms such support tube. For decoupling the individual transducer elements from each other radial slots 19 are provided at both sides of each transducer element within the ring-shaped or cylindrical counter mass 18. By this technique undesired resonation of the ring is prevented. All individual transducer elements of each transducer ring are energized with the same frequency and without phase shift.

I claim

1. A broadband omnidirectional electroacoustic transducer comprising:

a plurality of transducer rings positioned side-by-side along a common axis wherein each ring is comprised of a plurality of radially directed transducer elements which are located side-by-side around the circumference of said ring and are adapted for radial transmission of sound waves, the natural frequency of the transducer elements of each transducer ring differing from the natural frequency of the transducer elements of said adjacent transducer rings, the height H of said individual transducer elements of a particular transducer ring along the common axis being chosen such that H is less than or equal to $\lambda/2$, with $\lambda$ being the natural frequency of the transducer in said ring.

2. The transducer of claim 1, whereat each transducer element consists of a piezoelectric generator element, an outer resonant mass and a counter mass and all such transducer elements are supported by a common tube.

3. The transducer according to claim 2 with a compliance member provided between said counter mass of each transducer element and said common tube.

4. The transducer of claim 1, whereat each transducer element consists of a piezoelectric generator element and an outer resonant mass and all such transducer elements are supported by a common hollow cylindrical counter mass.

5. The transducer of claim 4, whereat radial decoupling slots are provided between the counter mass portions associated with adjacent transducer elements.

* * * * *